United States Patent [19]

Gusdorf

[11] 4,270,822

[45] Jun. 2, 1981

[54] CABINET AND DOOR ASSEMBLY

[75] Inventor: Walter Gusdorf, Creve Coeur, Mo.

[73] Assignee: Gusdorf Corporation, St. Louis, Mo.

[21] Appl. No.: 40,504

[22] Filed: May 21, 1979

[51] Int. Cl.[3] ..... A47B 47/00

[52] U.S. Cl. ..... 312/265; 312/324

[58] Field of Search ..... 312/265, 264, 263, 324, 312/326, 245, 138 R, 257 SK

[56] References Cited

U.S. PATENT DOCUMENTS

| | | | |
|---|---|---|---|
| 3,848,942 | 11/1974 | Fanini | 312/111 |
| 3,879,096 | 4/1975 | Blodee | 312/265 |
| 3,964,811 | 6/1976 | McClelland | 312/265 |

*Primary Examiner*—Alexander Grosz

*Attorney, Agent, or Firm*—Gravely, Lieder & Woodruff

[57] ABSTRACT

A cabinet assembly combining easily assembled sides with bottom and top shelf members in position to space the sides apart and fix the dimensions of the cabinet by being retained in position by tension elements adjacent the bottom and top shelf members, together with closure means hingedly carried by hinge socket means carried by the bottom and top shelf members, and stop means cooperating with the tension elements to maintain the hinge socket means in a substantially fixed spacing irrespective of the attempts to lift the cabinet by force applied on the shelf members.

2 Claims, 4 Drawing Figures

CABINET AND DOOR ASSEMBLY

BACKGROUND OF THE INVENTION

Cabinet assemblies are generally made up of vertical side panels held in spaced parallel relation by a bottom shelf member and a top shelf member usually rigidly secured so that these parts are able to sustain loads. Removable shelves are normally inserted and rest on supports mounted in the vertical side panels. Of course, there are in some cases doors or closure means hinged to the cabinet to enclose the items placed on the shelves. Usually the closures are framed panels which may be glass or some non-see-through material.

It is known to construct certain cabinets in modular form so that various open front and closed front units can be used in various assemblies. One example is disclosed in the patent to Winkels U.S. Pat. No. 3,589,784 issued June 29, 1971. The essential concept here is to provide a modular assembly suitable to allow for the construction of varying lengths so that a desired row of cabinet units of horizontal or vertical dimensions could be created. Certain members of the units are hollow to receive rods which extend through the units and are held in position by threaded means. A different modular cabinet construction is disclosed by Fanini in U.S. Pat. No. 3,848,942 issued November 1974. Here modular furniture is provided to develop a variety of units of different dimensions, so that selected units can be made to fit together to serve a wide variety of uses. In addition the patent of Fanini is directed toward providing designs suitable for knock-down marketing. The general concepts disclosed in the foregoing prior patents have been applied to wall mounted cabinetry by Blodee in U.S. Pat. No. 3,879,096 issued Apr. 22, 1975.

BRIEF SUMMARY OF THIS INVENTION

This invention is concerned with cabinet assembly constructions in which an important characteristic is the means for simplifying hinged mounting of closures and protecting the mounting against coming apart in a consumer assembled cabinet.

An important object is to provide means to carry hinge sockets which receive closure hinge pins, and means to hold the cabinet assembled in a way that will keep the hinge sockets suitably positioned so the closure hinge pins will remain in the hinge sockets.

It is also an important object of this invention to arrange hinge socket means in lower and upper shelves so they are in vertical alignment to receive hinge pin means carried by a closure, and to provide means for holding the socket means in such a position that the hinge pins do not escape from the socket means.

A further object of this invention is to provide a cabinet assembly with uniquely mounted hinged closure means, such as unframed glass closure panels, wherein the principal components of the cabinet are made to cooperate to accomplish the secure mounting of such a closure.

BRIEF DESCRIPTION OF THE DRAWINGS

Certain embodiments of the invention are disclosed in the accompanying drawings, wherein.

DETAILED DESCRIPTION OF THE EMBODIMENT

Figure 1:
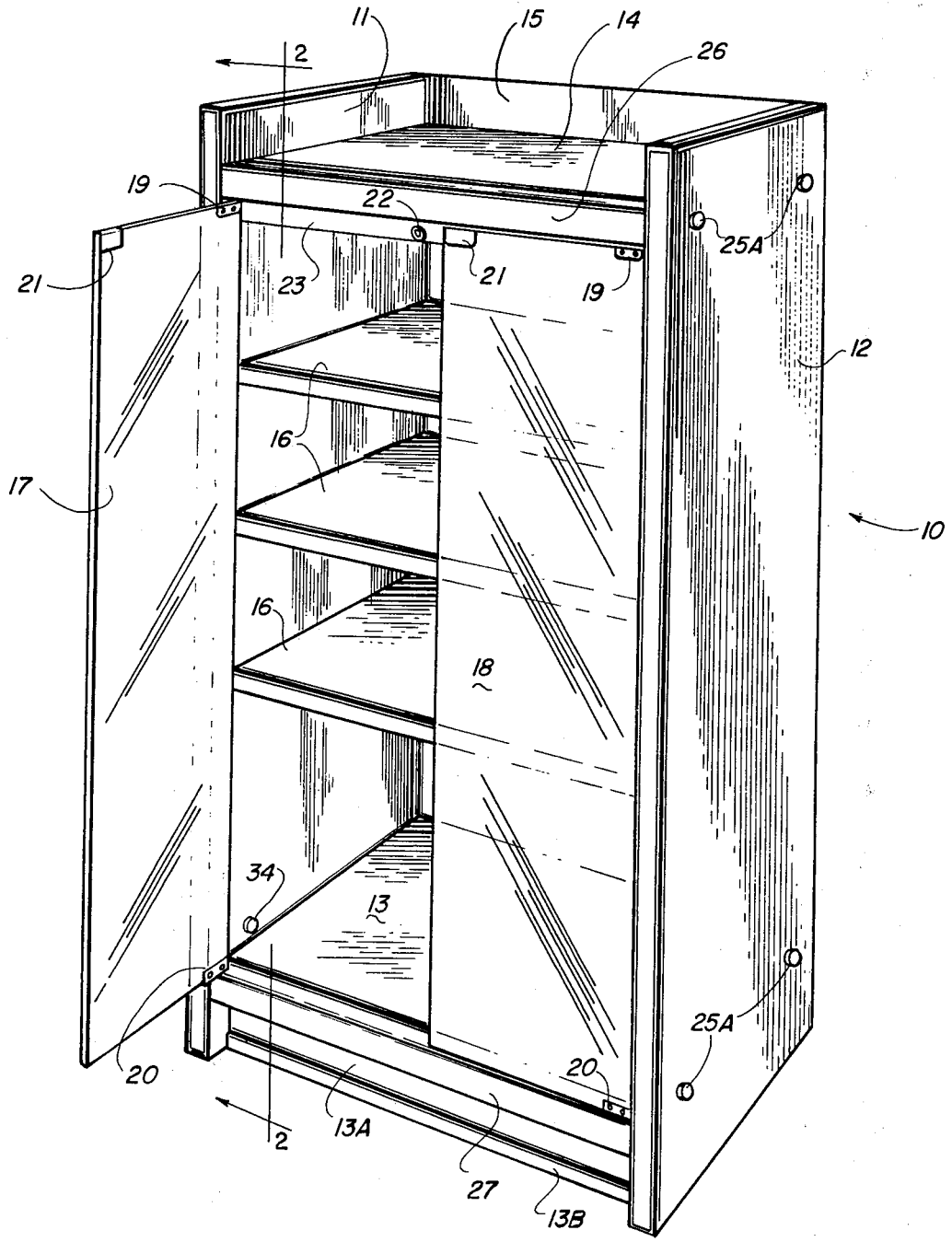
FIG. 1 is a front perspective view of a cabinet assembly having an unframed glass closure hingedly mounted thereon.

Referring now to the several views of the drawings one form of cabinet assembly has been illustrated in FIG. 1 at 10. The assembly includes vertical side members 11 and 12 spaced apart by a base shelf member 13 and an upper shelf member 14. A back panel 15 is provided to close the rear of the cabinet. A plurality of intermediate shelves 16 are mounted between the vertical side members 11 and 12, and these shelves may be adjusted as to spacing, although no means has been shown since it is common in the mounting of cabinet shelves. The front of the cabinet assembly is provided with a pair of unframed glass closures shown at the left side at 17 and at the right side at 18. Each of the closures 17 and 18 is provided with an upper hinge 19 and a lower hinge at 20. These hinges are of a well known construction having a U-shape body which fits over the adjacent edge of the glass closure and are secured by suitable clamping screws so that a projecting pivot pin formed on the hinge body will be in a position to fit into hinge socket means to be referred to presently. It is also shown that each of the closures 17 and 18 is provided at an upper corner with a magnetic retainer 21 which engages a suitable holding magnet 22 (only one being shown) when the closures are to be brought into closing position in front of the shelves 16.

Figure 2:
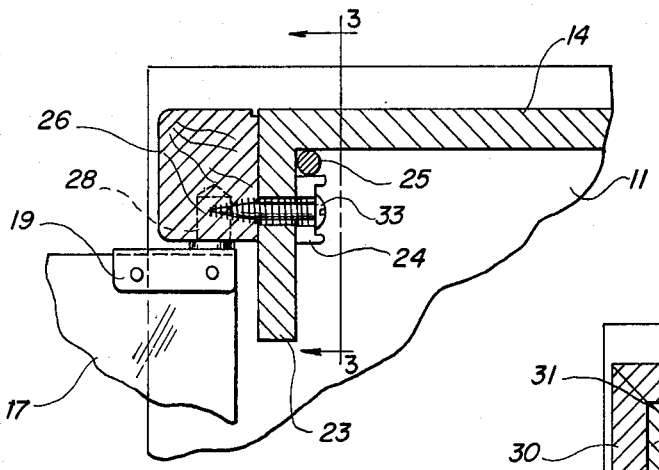
FIG. 2 is an enlarged and fragmentary sectional view of the hinge mounting provisions incorporated in the cabinet, the view being taken along line 2—2 in FIG. 1.

The structure seen along the line 2—2 in FIG. 1 has been shown in fragmentary and enlarged detail in FIG. 2, and reference will now be made to that view. The upper shelf 14 is provided with a depending closure stop means 23, and the forwardly facing surface thereof carries an upper rail member 26 which is held in place on the closure stop means 23 by suitable threaded members 33 which also position a bumper element 24 at the inner or backside of the closure stop means 23. The upper rail member 26 carries hinge socket means 28 for the reception of the hinge pin (not shown) projecting upwardly from the hinge 19. The hinge 19 is a common type of cabinet hardware that is well known and is commonly used to support glass doors or closures. There is also shown in FIG. 2 the lower rail member 27 which is secured to the depending skirt 13A on the base shelf member 13. A suitable finishing trim strip 13B is applied to the skirt 13A. The rail member 27 carries the hinge socket means 28 for the reception of the hinge pin carried on the bottom hinge 20. The lower rail member 27 forms part of the finished front for the base shelf member 13.

There has been shown in FIGS. 1 and 2 tension rods 25 arranged in a pair just below the base shelf member 13, and a second pair located just below upper shelf member 14. These tension rods are utilized to retain the vertical side members 11 and 12 in abutment with the base shelf member 13 and the upper shelf member 14. The ends of each tension rod are threaded so that suitable barrel nuts 25A can be threaded up to secure the rods in assembly. When the tension rods are removed the various parts of the shelf assembly can be dismantled and packaged in flat condition to make up a readyto-assembly kit. Suitable means (not shown) is provided for attaching the back panel 15, and the glass closure means 17 and 18 are preassembled with the necessary hardware such as hinges and magnetic retainers.

Figure 3:
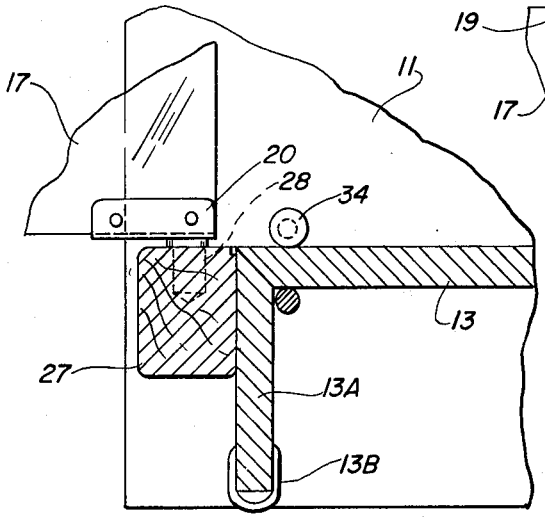
FIG. 3 is a fragmentary view taken along line 3—3 in FIG. 2.
Figure 3:
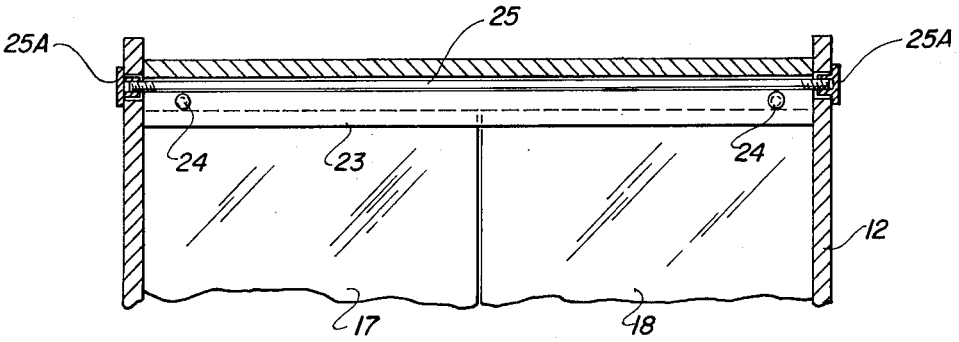

An important feature of this invention is shown in FIGS. 2 and 3 where in the assembly of the rail member 26 to the face surface of the closure stop means 23 threaded means 33 are utilized to connect these parts and also to locate bumpers 24 at a position just below the adjacent tension rod 25. This construction when properly assembled provides means for preventing upward movement of the rail member 26 so that it will not be possible to have the pin on the hinge means 19 escape from the socket means 28. If the escape were permitted, the closure 17, as well as the closure 18 would fall away from operative position. When the closure means are unframed glass the resulting danger is of course obvious if these closures become disconnected. As seen in FIG. 3 there are a pair of bumpers 24 mounted by threaded means 33 to the rear surface of the closure stop means 23. As seen in FIGS. 1 and 2 the closure stop means 23 extends below the upper rail 26 so as to expose a portion thereof for the convenient mounting of the magnetic holding means 22.

Figure 4:
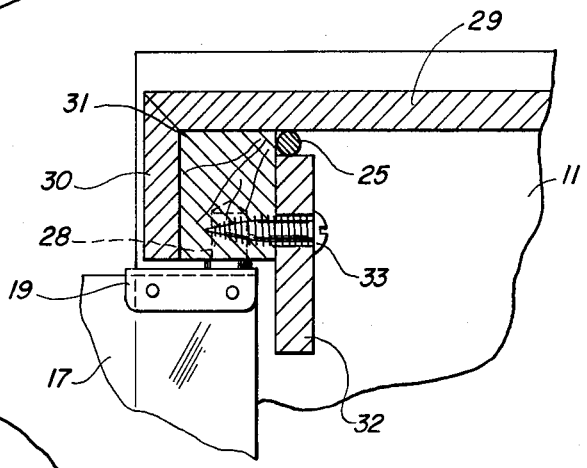
FIG. 4 is a fragmentary sectional view of a modification over the structure seen in FIG. 2.

In FIG. 2, means in the form of buttons 34 (one being seen also in FIG. 1) are inserted in the inner surfaces of the left and right vertical side members 11 and 12. The location of the buttons 34 is selected to cause proper positioning of the base shelf member 13 so the closures 17 and 18 will fit properly, and to prevent allowing upward lift on the base shelf member 13 being transmitted into the closures 17 and 18. The buttons 34 receive such lift forces and transmit the forces through the side members 11 and 12, A modification of the assembly features seen in FIGS. 1 and 2 is illustrated in FIG. 4 with respect to the upper rail portion of the assembly. In this arrangement the modified upper shelf 29 extends forwardly and is formed with a front flange 30 of a suitable width to cover a rail member 31 which is used to support the hinge socket means 28 previously referred to. The rail member 31 supports a stop means 32 by the use of suitable threaded means 33 connecting these two parts in assembly. The stop means 32 is positioned so that its upper margin is adjacent the tension rod 25, thereby making the stop means 32 function in the same means as the bumpers mounted on the stop means 23.

The foregoing description has referred to the novel features in a cabinet assembly having hingedly mounted closure means which are prevented from becoming unhinged should an effort be made, in moving the cabinet assembly see in FIG. 1, by applying a lifting force on the upper shelf member 14 through the upper rail 26 and the attached closure stop means 23. Such a lifting force can easily be applied when the closure means 17 and 18 are in the open position, and if upward movement of the rail 26 takes place the hinge pin means in the sockets 28 can be released so that the closure means 17 and 18 will fall away for lack of support. The present unique structure prevents upward movement of the rail 26, as well as the rail 31 in the modified assembly of FIG. 4, by blocking such movement through the use of the bumpers 24 or the stop means 32. It is also provided that upward lift applied to the base shelf member 13 at the lower rail 27 or skirt 13A is confined by buttons 34 to being exerted on the side members 11 and 12 and not into the closures. Glass closures are not intended to be able to withstand such compressive loading. While the present structure has made reference to the mounting of glass closures 17 and 18, it is within the scope of the present disclosure not to limit the closure means to unframed glass as other types of closures may be mounted in the same manner and be effectively prevented from escaping the hinge socket mounting by the unique and simple means shown in detail in FIGS. 2, 3 and 4. Furthermore, without buttons 34 in place, it may be possible to lift the base shelf member 13 to some extent and loosen the structure so that when the base shelf member 13 is pushed down to its place against the tension rod 25 the closure means hinges can disconnect from the sockets and allow the closures to become disconnected.

What is claimed is:

1. In a cabinet assembly the improvement of: spaced vertical side members; vertically spaced top and bottom horizontal shelf members extending between and separating said side members, said side and shelf members framing the open front of the cabinet assembly; a plurality of tension elements extending between said side members adjacent said bottom shelf member and also adjacent said top shelf member, said tension elements operatively drawing said vertical side members into assembly abutment with the shelf members; rail-forming means along the front of said spaced shelf members; hinge socket means carried by each of said rail-forming means so as to be in vertically spaced and aligned facing positions; closure means for the open front of the cabinet assembly; first hinge means on said closure means engageable in said socket means carried by said rail-forming means along the front of said bottom shelf member; second hinge means on said closure means in position to engage in said socket means carried by said rail-forming means along the front of said top shelf member, one of said tension elements being disposed adjacent said socket means carried by said rail-forming means for said top shelf member; and stop means adjacent said rail-forming means on said top shelf member in position to provide a portion thereof to position said closure means in closed position at the cabinet front and said stop means providing an abutment to engage said one tension element and block upward displacement of said top shelf member relative to said side members.

2. In a cabinet assembly the improvement of: spaced vertical side members; vertically spaced upper and lower horizontal shelf members extending between and separating said side members; a plurality of tension elements extending between said side members adjacent the under surface of said lower one of said shelf members and also adjacent the underside of said upper one of said shelf members, said tension elements operatively drawing said vertical side members into assembly abutment with said shelf members; hinge socket means carried by each of said shelf members in vertically spaced and aligned facing positions; closure means; first hinge means on said closure means engageable in said socket means carried by the lower one of said vertically spaced shelf members; second hinge means on said closure means in position to engage in said socket means carried by the upper one of said vertically spaced shelf members, one of said tension elements being disposed adjacent said socket means carried by said upper shelf member; and stop means carried by said upper shelf means, said stop means forming an abutment for said closure means in the closed position and having horizontally spaced bumper elements disposed adjacent and below said one of said tension elements to engage said one tension element and block upward displacement of said upper shelf member relative to said side members.

* * * * *